US008778865B2

(12) United States Patent
Ikoshi et al.

(10) Patent No.: US 8,778,865 B2
(45) **Date of Patent: *Jul. 15, 2014**

(54) SOFTENER COMPOSITION

(75) Inventors: Risa Ikoshi, Tokyo (JP); Makoto Kubo, Wakayama (JP); Takaya Sakai, Wakayama (JP)

(73) Assignee: Kao Corporation, Tokyo (JP)

( * ) Notice: Subject to any disclaimer, the term of this patent is extended or adjusted under 35 U.S.C. 154(b) by 88 days.

This patent is subject to a terminal disclaimer.

(21) Appl. No.: 13/579,614

(22) PCT Filed: Mar. 8, 2011

(86) PCT No.: PCT/JP2011/055290

§ 371 (c)(1),
(2), (4) Date: Aug. 17, 2012

(87) PCT Pub. No.: WO2011/111674

PCT Pub. Date: Sep. 15, 2011

(65) Prior Publication Data

US 2012/0329702 A1 Dec. 27, 2012

(30) Foreign Application Priority Data

Mar. 9, 2010 (JP) ..... 2010-51770

(51) Int. Cl.

| | |
|---|---|
| ***C11D 1/645*** | (2006.01) |
| ***C11D 1/62*** | (2006.01) |
| ***C11D 3/00*** | (2006.01) |
| ***D06M 13/463*** | (2006.01) |

(52) U.S. Cl.

CPC ..... *D06M 13/463* (2013.01); *C11D 1/62* (2013.01); *C11D 3/001* (2013.01)

USPC ..... 510/527; 510/522

(58) Field of Classification Search

USPC ..... 510/522, 527

See application file for complete search history.

(56) References Cited

U.S. PATENT DOCUMENTS

| | | | | |
|---|---|---|---|---|
| 8,497,235 | B2 * | 7/2013 | Ikoshi et al. | 510/515 |
| 2003/0060389 | A1 | 3/2003 | Ushio et al. | |
| 2003/0130162 | A1 | 7/2003 | Llosas et al. | |
| 2005/0090423 | A1 | 4/2005 | Ushio et al. | |
| 2011/0263476 | A1 | 10/2011 | Ikoshi et al. | |

FOREIGN PATENT DOCUMENTS

| | | | |
|---|---|---|---|
| CN | 1680278 | A | 10/2005 |
| CN | 101020644 | A | 8/2007 |
| CN | 101575299 | A | 11/2009 |
| EP | 1043011 | A1 * | 10/2000 |
| JP | 5-98571 | A | 4/1993 |
| JP | 7-18575 | A | 1/1995 |
| JP | 7-18577 | A | 1/1995 |
| JP | 2001-192966 | A | 7/2001 |
| JP | 2003-155668 | A | 5/2003 |
| JP | 2003-519294 | A | 6/2003 |
| JP | 2010-159529 | A | 7/2010 |
| WO | WO 01/47489 | A1 | 7/2001 |
| WO | WO 2010/067885 | A1 | 6/2010 |

OTHER PUBLICATIONS

Machine Generated Translation of JP-7-18577-A, published on Jan. 20, 1995.

Machine Generated Translation of JP-5-98571-A, published Apr. 20, 1993.

International Search Report issued in PCT/JP2011/055290 dated Apr. 5, 2011.

Chinese Office Action for corresponding Application No. 201180013158.7 dated Jan. 6, 2014 (with English translation).

* cited by examiner

*Primary Examiner* — John Hardee

(74) *Attorney, Agent, or Firm* — Birch, Stewart, Kolasch & Birch, LLP

(57) ABSTRACT

The present invention provides the softener composition containing the specific quaternary ammonium salts (I) and (II) each having a bis(polyalkoxyalkanol) structure, represented by the formulae (I) and (II) respectively, at a weight ratio of (I):(II) of 50.1:49.9 to 99.99:0.01.

6 Claims, No Drawings

SOFTENER COMPOSITION

FIELD OF THE INVENTION

The present invention relates to a softener composition, and more particularly a liquid softener composition.

BACKGROUND OF THE INVENTION

For softening and finishing fibers and clothes, quaternary di-long-chain alkyl ester di-short-chain alkyl ammonium salts have been conventionally used in softener compositions. In order to provide softener compositions that have effects of imparting water-absorbability as well as softening and disperse a softener better, there have been known methods, including addition of various additives and use of a base material having an alkenyl group (see, for example, JP-A-07-18575, JP-A-2001-192966, JP-B-2003-519294).

JP-A-2010-159529, published on Jul. 22, 2010, discloses a softener composition containing a quaternary ammonium salt having a bis(polyalkoxyalkanol) group.

SUMMARY OF THE INVENTION

The present invention relates to a softener composition, containing a quaternary ammonium salt (I) represented by formula (I) and a quaternary ammonium salt (II) represented by formula (II) at a weight ratio of quaternary ammonium salts (I) to (II), (I):(II), of 50.1:49.9 to 99.99:0.01:

(I)

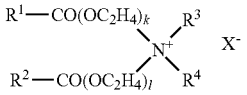

wherein, $R^1$ and $R^2$, which may be the same as or different from each other, represent a hydrocarbon group having 11 to 23 carbon atoms; $R^3$ and $R^4$, which may be the same as or different from each other, represent a hydrocarbon group having 1 to 4 carbon atoms that may be substituted with a hydroxy group; k and 1, which may be the same as or different from each other, represent an integer showing the mole number of added oxyethylene group ranging from 1 to 4; and $X^-$ represents an anion; and (II)

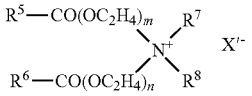

wherein, $R^5$ and $R^6$, which may be the same as or different from each other, represent a hydrocarbon group having 11 to 23 carbon atoms; $R^7$ and $R^8$, which may be the same as or different from each other, represent a hydrocarbon group having 1 to 4 carbon atoms that may be substituted with a hydroxy group; m and n, which may be the same as or different from each other, represent an integer showing the mole number of added oxyethylene group ranging from 5 to 10; and $X'^-$ represents an anion.

The present invention further provides a method for softening a fiber product, containing treating the fiber product with the composition of the present invention, and use of the composition of the present invention for softening a fiber product.

DETAILED DESCRIPTION OF THE INVENTION

The present invention provides a softener composition, and more in details a liquid softener composition, that has both effects for softening and imparting water-absorbability which is generally hardly imparted by a softener, and has good properties for easy handling, such as no thickening with time and a good dispersion of components.

According to the present invention, provided is a softener composition that has both good effects for softening and imparting water-absorbability, and has good properties for easy handling, having a high fluidity at a room temperature and a good dispersion of components.

<Quaternary Ammonium Salt (I)>

The quaternary ammonium salt (I) is a compound represented by formula (I). In formula (I), from the viewpoint of effect of softening, $R^1$ and $R^2$ each preferably represent a hydrocarbon group having 11 to 23, more preferably 15 to 21, and even more preferably 15 to 17 carbon atoms. The hydrocarbon group is preferably selected from alkyl and alkenyl groups. Specific examples of the hydrocarbon group include species of undecyl group, species of dodecyl group, species of tridecyl group, species of tetradecyl group, species of pentadecyl group, species of hexadecyl group, species of heptadecyl group, species of octadecyl group, species of nonadecyl group, species of icosyl group, species of henicosyl group, species of docosyl group, species of tricosyl group, species of undecenyl group, species of dodecenyl group, species of tridecenyl group, species of tetradecenyl group, species of pentadecenyl group, species of hexadecenyl group, species of heptadecenyl group, species of octadecenyl group, species of nonadecenyl group, species of icosenyl group, species of heneicosenyl group, species of docosenyl group, and species of tricosenyl groups. Preferred are all variations of pentadecyl, heptadecyl, nonadecyl, heneicosanyl, pentadecenyl, heptadecenyl, nonadecenyl, heneicosenyl groups, and more preferred are all variations of pentadecyl, heptadecyl, pentadecenyl, and heptadecenyl groups. As used herein, the term "species" refers to both a linear group and a branched chain group.

In formula (I), $R^3$ and $R^4$ each independently represent a hydrocarbon group having 1 to 4 carbon atoms that may be substituted with a hydroxy group. The hydrocarbon group is preferably selected from alkyl and hydroxyalkyl groups. From the viewpoints of dispersibility, $R^3$ and $R^4$ each preferably represent an alkyl or hydroxy alkyl group having 1 to 3, more preferably 1 to 2 carbon atoms, and even more preferably a methyl or hydroxyethyl group. $R^1$ and $R^2$ are separately connected to the nitrogen via polyoxyethylene chains represented in formula (I) as $(OC_2H_4)_k$ and $(OC_2H_4)_1$, respectively. In formula (I), k and 1 represent an integer showing the mole number of added oxyethylene group of the respective polyoxyethylene chains ranging and are 1 to 4, which may be the same as or different from each other. From the viewpoints of ease of handling and effect of imparting water-absorbability of the softener composition of the present invention, k and 1 each preferably represent 2 or 3. $X^-$ represents an anion selected from those suitable for softener. Examples of the anion include halogens such as chlorine, bromine, and iodine, and sulfate ions such as methylsulfate and ethylsulfate. Particularly preferred are a chloride ion and a methylsulfate ion.

<Quaternary Ammonium Salt (II)>

The quaternary ammonium salt (II) is a compound represented by formula (II). In formula (II), $R^5$ and $R^6$ are the same examples and preferences as $R^1$ and $R^2$. $R^7$ and $R^8$ are the same examples and preferences as to $R^3$ and $R^4$. $X'^-$ is the same examples and preferences as to $X^-$ in formula (I). m and n, which may be the same as or different from each other, represent an integer showing the mole number of added oxyethylene group in the respective polyoxyethylene chains, ranging from 5 to 10. From the viewpoints of effects of softening and imparting water-absorbability of the softener composition of the present invention, m and n each preferably represent 6 to 8, more preferably 6 to 7, and even more preferably 6.

<Softener Composition>

The softener composition of the present invention contains the quaternary ammonium salt (I) represented by formula (I) and the quaternary ammonium salt (II) represented by formula (II) at a weight ratio of quaternary ammonium salts (I) to (II), (I):(II), of 50.1:49.9 to 99.99:0.01. From the viewpoints of effects of imparting water-absorbability and ease of handling of the softener composition of the present invention, the weight ratio (I):(II) is preferably 60:40 to 99.9:0.1, more preferably 70:30 to 99:1, and even more preferably 70:30 to 99.9:0.1.

The softener composition of the present invention preferably contains the quaternary ammonium salts (I) and (II) in the total amount of 1 to 40% by weight, more preferably 2 to 30% by weigh, even more preferably 3 to 20% by weight, still even more preferably 4 to 10% by weight, and yet still even more preferably 5 to 8% by weight. The total content not less than 1% by weight can provide a softener composition having higher performances, and the total content not more than 40% by weight provides a stable solution of a softener composition and therefore makes production of the softener composition easier.

From the viewpoint of effects of imparting water-absorbability, the softener composition of the present invention preferably contains two or more quaternary ammonium salts represented by formula (I). In this case, two or more quaternary ammonium salts represented by formula (I) are preferably different from each other in the total number of moles of oxyethylene group added, that is, the total of k and 1 in formula (I).

In the softener composition of the present invention, from the viewpoint of effects for softening of the softener composition, a number-average value of the addition mole number of oxyethylene groups per polyoxyethylene chain of quaternary ammonium salts (I) and (II), that is, an average of numbers k, l, m, and n in the formulae (I) and (II), is preferably the number from 1 to 4, more preferably the number more than 1 and not more than 4, and even more preferably the number from 2 to 3.5. The average of numbers k, l, m, and n is a value calculated according to the equation $[(k+l)*x_I+(m+n)*x_{II}]/2(x_I+x_{II})$, in which $X_I$ and $X_{II}$ represent a molar ratio of quaternary ammonium salts (I) to (II) $X_I:X_{II}$.

The softener composition of the present invention further contains water. The water generally makes up the rest part. The softener composition of the present invention preferably has a pH value of 1.5 to 6 at 20° C. The lower pH is more suitable from the viewpoint of antiseptic and bactericidal effects, but increases a risk of degradation of components generally blended in the composition. As thus, the pH is more preferably 1.5 to 5, and even more preferably 2 to 4.5. To adjust pH, any inorganic or organic acid or alkali can be used. Specific examples of the agent for adjusting pH include hydrochloric acid, sulfuric acid, phosphoric acid, alkylsulfuric acid, p-toluenesulfonic acid, carboxylic acids, such as acetic acid, citric acid, malic acid, succinic acid, lactic acid or glycolic acid, carboxylic acid-containing polymers, such as polyacrylic acid, hydroxyethanediphosphonic acid, tripolyphosphoric acid, phytic acid, ethylenediaminetetraacetic acid, short-chain amine compounds (e.g., triethanolamine, diethanolamine, dimethylamine, N-methylethanolamine, N-methyldiethanolamine, N-methyl-N-(2-hydroxyethyl)-N-(2-cyanoethyl)amine, N-methyl-N-(2-hydroxyethyl)propanediamine, 2,3-dihydroxy-N,N-dimethylpropylamine, and N,N-di(2-hydroxyethyl)propanediamine) and alkylene oxide-adducts thereof, and long-chain amine compounds in which a chain connecting to the nitrogen has 8 to 36 carbon atoms and alkylene oxide-adducts thereto. These agents may be used in a salt form. Examples of the agent also include alkaline metal hydroxides, alkaline metal carbonates, and alkaline metal silicates. Among them exemplified, preferred are hydrochloric acid, methylsulfuric acid, sodium hydroxide, diethanolamine, and triethanolamine.

The softener composition of the present invention is easy to handle. Moreover an alkylene oxide adduct to an alcohol, amine or a fatty acid may be used to improve properties of dispersing quaternary ammonium salts (I) and (II). The amount of such an additive, however, may be significantly decreased, compared with the usual amount when used, due to ease of handling of the softener composition of the present invention. In the alkylene oxide adduct to an alcohol, an amine or a fatty acid, a hydrocarbon chain may be linear or branched optionally with unsaturation. The hydrocarbon chain may have a distribution of carbon chain lengths. From the viewpoints of an effect of softening of the softener composition and dispersibility of quaternary ammonium salts in the softener composition, the hydrocarbon chain preferably has 6 to 20 carbon atoms, and more preferably 8 to 18 carbon atoms. In cases of linear chains, the hydrocarbon chain preferably has 6 to 14 carbon atoms, more preferably 8 to 12 carbon atoms, and even more preferably 8 to 10 carbon atoms. In cases of branched chains, the hydrocarbon chain preferably has 6 to 17 carbon atoms, more preferably 9 to 17 carbon atoms, and even more preferably 13 carbon atoms. Examples of a starting material for the adduct include Exxsol (ExxonMobil Chemical), Lutensol TO (BASF), and Oxocol C13 (KH Neochem Co., Ltd.). In cases of alcohol-alkylene oxide adducts, a starting alcohol may be primary or secondary, but preferably primary, because a primary alcohol-alkylene oxide adduct provides better dispersibility of components in the softener composition. An alcohol having 13 carbon atoms is produced from dodecene, a starting material of which may be butylene or propylene. In the case of the hydrocarbon chain has an unsaturated bond, it preferably has 18 carbon atoms. A steric structure of the unsaturated bond may be cis- or trans-form. The hydrocarbon chain may be a mixture of both cis-form and trans-form. A ratio of cis-isomer/trans-isomer is more preferably 25/75 to 100/0 (weight ratio). The alkylene oxide is preferably ethylene oxide (EO). Ethylene oxide may be added together with propylene oxide (PO) or butylene oxide (BO). An average number of moles of EO added is 10 to 100, more preferably 20 to 80, and even more preferably 30 to 60. If PO or BO is added together with EO, an average number of moles of added PO or BO is 1 to 5, preferably 1 to 3. In this case, PO or BO may be added before or after addition of EO. Examples of the EO adduct include a nonyl alcohol-EO(9)PO(1), a primary isononyl alcohol-EO(40), a primary isodecyl alcohol-EO(20), a lauryl alcohol-EO(20), a primary isohexadecyl alcohol-EO(60), a primary isotridecyl alcohol-EO(40), a beef tallow alkyl amine-EO(60), a beef tallow alkyl amine-EO(60), an oleylamine-EO(50), and a lauric acid-EO

(20) adducts, in which "EO(X)" refers to that EO is added in an average number X of moles, and the same applies to PO. Commercial products can also be used, including Emalex series of Nihon Emulsion Co., Ltd., Emulmin series of Sanyo Chemical Industries, Ltd., TDA series and Esomin series of Lion Co., Ltd., Softanol series including Softanol 300 of Nippon Shokubai Co., Ltd., and Lutensol series of BASF. The alkylene oxide adduct of an alcohol, amine, or fatty acid is preferably blended in an amount of 0 to 5% by weight, more preferably 0 to 2% by weight, and even more preferably 0 to 1% by weight of the whole composition.

In order to further decrease the viscosity of the composition, an inorganic or organic salt (except for the quaternary ammonium salt (I) or (II)) can be used in a small amount. Specific examples of the other salt include sodium chloride, potassium chloride, calcium chloride, magnesium chloride, aluminum chloride, sodium sulfate, magnesium sulfate, potassium sulfate, sodium nitrate, magnesium nitrate, sodium p-toluenesulfonate, sodium glycolate, sodium acetate, potassium acetate, potassium glycolate, and sodium lactate. Preferred are calcium chloride and magnesium chloride. The salt is added in an amount of 0 to 2% by weight, more preferably 0 to 1% by weight, and even more preferably 0 to 0.5% by weight.

In cases of applying the liquid softener composition of the present invention to fiber products such as cloths, the composition can further contain one or more silicones at any proportion, alone or a mixture thereof, selected from dimethylpolysiloxane and a modified dimethylpolysiloxanes having an organic functional group, in order to make the fiber product stiff and improve smoothness of the product in ironing. Examples of the organic functional group include an amino group, an amide group, an alkyl group, an aralkyl group, a carboxyl group, a fluoroalkyl group, an ester group derived from a higher alcohol, a polyether group, an epoxy group, a carbinol group, a mercapto group, a phenyl group, a methacryl group, and groups having two or more functionalities such as aminopolyether, amidopolyether, and alkyl alcohol. The silicone is preferably selected from dimethylsilicone, polyoxyethylene-modified silicones, silicones having a hydrogen atom or a hydroxy group, and emulsified products thereof.

In order to make a user conscious of using the softener composition, the softener composition can further contain a perfume. Examples of the perfume include various natural and synthetic perfumes commonly used in softener compositions such as those described in "Gousei Kouryou, Kagaku To Shouhin Chishiki (synthetic perfume, chemistry and knowledge on products) ", Indo Motoichi, Chemical Daily Co., Ltd., 1996, and "Perfume and Flavor Chemicals", Steffen Arctander, MONTCLAIR, N.J., 1969.

In order to improve the appearance of the softener composition, the composition can further contain at least one water-soluble dye selected from acid dyes, direct dyes, basic dyes, reactive dyes, and acid mordant dyes. Specific examples of the dye are found in "Senryou Binran (dye handbook)" (Society of Synthetic Organic Chemistry, Japan eds., Maruzen, issued on Jul. 20, 1970).

In order to enhance antiseptic and bactericidal capacity, the softener composition of the present invention can further contain at least one agent selected from common antibacterial and bactericidal agents. Examples of the common antibacterial or bactericidal agent include alcohols having 1 to 8 carbon atoms, benzoic acids, and phenols. Specific Examples thereof include ethanol, propylene glycol, benzyl alcohol, salicylic acid, methyl parahydroxybenzoate, and cresol.

The softener composition of the present invention can further contain a common chelating agent, including phosphonic acid chelating agents such as hydroxyethanediphosphonic acid and carboxylic acid chelating agents such as ethylenediaminetetraacetic acid, citric acid, and polyacrylic acid.

The softener composition of the present invention can further contain, as an optional component, any other known additive generally blended in softener compositions in addition to those described above within the range that does not impair the effects of the present invention. Examples of the optional component and a preferred amount thereof are as follows: higher fatty acids such as stearic acid, oleic acid and palmitic acid and derivatives thereof such as an ester formed with a lower alcohol in an amounts of 0 to 2% by weight; nonionic surfactants such as fatty acid glycerol ester (e.g., stearic acid glycerol ester) in an amount of 0 to 1% by weight; higher alcohols such as stearyl, palymityl, and oleyl alcohols in an amount of 0 to 3% by weight; and low temperature stabilizers such as ethylene glycol and glycerol in an amount of 0 to 10% by weight. In addition, ureas, pigments, cellulose derivatives, UV absorbers, and fluorescent brighteners may also be blended.

The softener composition of the present invention is suitably used for softening fiber products such as clothes and bedclothes.

The softener composition of the present invention is used at various concentrations depending on the application and the form to be used. In cases of applying to fiber products such as clothes, the composition is preferably diluted such that the total concentration of quaternary ammonium salts (I) and (II) of the present invention is 0.001 to 3% by weight, and preferably 0.01 to 1% by weight to a treatment medium, preferably water such as rinsing water in a washing process.

The quaternary ammonium salt (I) of the present invention can be produced, for example, by a method containing the following steps 1 and 2.

Step 1: reacting a halopolyethoxyethanol (III) represented by formula (III):

$$Z—(C_2H_4O)_o—C_2H_4OH \quad \text{(III)}$$

wherein, Z represents a halogen atom; and o represents an integer from 0 to 3, with an amine represented by formula (IV):

$$R^3—NH_2 \quad \text{(IV)}$$

wherein, $R^3$ represents a hydrocarbon group having 1 to 4 carbon atoms that may have a hydroxy group, to obtain a bis(polyethoxyethanol)alkylamine or bis(polyethoxyethanol) hydroxyalkylamine.

Step 2: esterifying the bis(polyethoxyethanol)alkylamine or the bis(polyethoxyethanol) hydroxyalkylamine, produced in the step 1, with a fatty acid or a derivative thereof and quaternizing the resultant.

In the step 1, the halopolyethoxyethanol (III) is preferably used in an amount of stoichiometrically 0.3 to 2 equivalents, and more preferably 0.4 to 1.8 equivalents to the amine represented by formula (IV) [i.e., halopolyethoxyethanol (III)/amine (IV)]. As a reaction medium, water and alcohols such as ethanol may be used. A reaction temperature is preferably 70 to 110° C., and more preferably 80 to 100° C. A reaction time is preferably 1 to 5 hours.

In the step 1, the following two-stage reaction will produce the bis(polyethoxyethanol)alkylamine or the bis(polyethoxyethanol) hydroxyalkylamine with a higher yield:

first stage: reacting 0.3 to 0.6 eq. of halopolyethoxyethanol (III) with the amine represented by formula (IV) (preferably for 1 to 5 hours at 90 to 110° C.), neutralizing a hydrogen halide generated as a by-product and removing it in a salt form, and distilling off excess monomethylamine; and second stage: to a mixture of a bis(polyethoxyethanol) and a mono(polyethoxyethanol) products, adding the halopolyethoxyethanol (III) in an additional amount of 0.5 to 0.9 eq. to the mono(polyethoxyethanol) product, and reacting in water or an alcohol for 1 to 3 hours at 70 to 90° C., and distilling.

Excess halopolyethoxyethanol and unreacted amine and the like can be removed through purification such as distillation.

In the step 2, the bis(polyethoxyethanol)alkylamine or bis(polyethoxyethanol)hydroxyalkylamine (hereinafter, referred to as intermediate amine) produced in the step 1 is esterified with a fatty acid or a derivative thereof and the obtained amine is quaternized with a quaternizing agent.

In the esterification, a higher fatty acid having 12 to 24 carbon atoms, preferably 16 to 22 carbon atoms, and more preferably 16 to 18 carbon atoms or a derivative thereof is used. Specific examples of the fatty acid include myristic acid, palmitic acid, palmitoleic acid, stearic acid, oleic acid, linoleic acid, linolenic acid, and those prepared from natural fats and oils such as beef tallow, pork lard, palm oil, and soy oil by purification and hydrogenation or partial hydrogenation. Examples of the derivative of fatty acid include alkyl esters, acid chlorides, and acid anhydrides of fatty acids described above.

The produced amine is quaternized. For quaternization, a standard method using a quaternizing agent such as an alkyl halide having 1 to 4 carbon atoms that may have a hydroxy group (e.g., methyl chloride) and an alkylsulfate can be employed.

The quaternary ammonium salt (II) can also be produced by the same method as above except for replacing a halopolyethoxyethanol (V) represented by formula (V) for the halopolyethoxyethanol (III) and an amine represented by formula (IV') for the amine represented by formula (IV):

$$R^7—NH_2 \quad (IV')$$

wherein, $R^7$ represents a hydrocarbon group having 1 to 4 carbon atoms that may have a hydroxy group, $$Z—(C_2H_4O)_p—C_2H_4OH \quad (V)$$

wherein, Z represents the same meanings as in formula (III); and p represents an integer from 4 to 9.

As described above, the method of the present invention can efficiently and selectively produce the quaternary ammonium salts (I) and (II), having added oxyethylene chains with no distribution of the mole number by an appropriate selection of a halopolyethoxyethanol used in the step 1.

Quaternary ammonium salts (I) and (II) produced by the method can be appropriately purified by standard methods such as crystallization. The produced quaternary ammonium salts (I) and (II) can be used as components to produce the softener composition of the present invention.

A composition containing the produced quaternary ammonium salts (I) and (II) at a weight ratio (I):(II) of 50.1:49.9 to 99.99:0.01 is used for softening fiber products. A treatment with the composition containing the produced quaternary ammonium salts (I) and (II) at a weight ratio (I):(II) of 50.1:49.9 to 99.99:0.01 can soften fiber products. A method of treating a fiber product or fabric preferably contains immersing the fiber product or fabric in an aqueous dispersion containing the composition of the present invention diluted to an adequate concentration. A temperature in the treatment is preferably 0° C. to 40° C., and more preferably 5° C. to 30° C. The treatment can be conducted in a settled state, but preferably in a stirred state. A treating time is preferably 30 seconds to 10 minutes, and more preferably 1 to 5 minutes. In the treatment, a concentration of effective components, or the total concentration of quaternary ammonium salts (I) and (II), is preferably 15 ppm to 60 ppm, and more preferably 25 ppm to 40 ppm. A bath ratio is preferably 5 to 40 L/kg (fiber product). After the immersion, a standard method of dehydration and dry can provide a softened fiber product.

Examples

The following examples further describe and demonstrate embodiments of the present invention. The examples are given solely for the purpose of illustration and are not to be construed as limitations of the present invention.

In Examples, unless otherwise noted, "%" refers to "% by weight".

Preparation Example 1

In a pressure-resistant reaction vessel, 244 g of 41% monomethylamine in water, 182 g of 2-chloroethoxyethanol, and 80 g of water were reacted for 4 hours at 110° C. To the reaction mixture was added an aqueous solution of sodium hydroxide (the equivalent amount to the chloro-compound) to neutralize generated hydrochloric acid. Excess monomethylamine was distilled off under reduced pressure. The reaction mixture was transferred to a new reaction vessel. To this was added further 86 g of 2-chloroethoxyethanol, and reacted for 1 hour at 80° C. To the reaction mixture was added dropwise an aqueous solution of sodium hydroxide in an equivalent amount to the additional 2-chloroethoxyethanol over 30 minutes. The reaction mixture was aged for 30 minutes. Then, the solvent and the salt were removed. The product was distilled to isolate a di-substituted compound, (bis(2-ethoxyethanol) methylamine). The di-substituted compound was identified by NMR (400 MHz, $^1H$, Varian, Mercury 400). Then, 113 g of the di-substituted compound was reacted with 326 g of stearic acid for 23 hours at 180 to 200° C. under 180 to 200 Torr (24.0 to 26.7 kPa) to obtain a diesterified compound of bis(2-ethoxyethanol)methylamine. 44 g of the diesterified compound was dissolved in 50 g of isopropyl alcohol. In a pressure-resistant reaction vessel, to the solution was added 4.5 g of methyl chloride, and reacted for 5.5 hours at 88° C. to quaternize. The reaction mixture was added in cold acetone to form crystals. These crystals were dried to obtain a quaternary ammonium salt [compound (I-1)] represented by formula (I). The product was identified by NMR (400 MHz, $^1H$) and fat-and-oil analysis (acid value (JIS K 0070), saponification value (JIS K 0070), hydroxy value (JIS K 0070), amine value (ASTM D 2074), chloride ion concentration (silver nitrate titration), measurement of loss on drying (drying method)). A structure of the compound (I-1) is shown in Table 1.

Preparation Example 2

A quaternary ammonium salt [compound (I-2)] represented by formula (I) was prepared by the same method as in Preparation Example 1, except that 2-(2-chloroethoxy) ethoxyethanol was used instead of 2-chloroethoxyethanol. The compound (I-2) was identified by the same method as in Preparation Example 1. A structure of the compound (I-2) is shown in Table 1.

Preparation Example 3

A quaternary ammonium salt [compound (I-3)] represented by formula (I) was prepared by the same method as in Preparation Example 1, except that 2-(2-(2-chloroethoxy) ethoxy)ethoxyethanol was used instead of 2-chloroethoxyethanol. The compound (I-3) was identified by the same method as in Preparation Example 1. A structure of the compound (I-3) is shown in Table 1.

Preparation Example 4

133 g of N-methyldiethanolamine (Sigma-Aldrich Corp.) was reacted with 700 g of stearic acid for 23 hours at 180 to 200° C. under 180 to 200 Torr (24.0 to 26.7 kPa) to obtain a diesterified compound of N-methyldiethanolamine. 198 g of the di-esterified compound was dissolved in 200 g of isopropyl alcohol. The solution was fed into a pressure-resistant reaction vessel and 19 g of methyl chloride was added, and the mixture was reacted for 5.5 hours at 88° C. to quaternize. The reaction mixture was added in cold acetone to form crystals. These crystals were dried to obtain a quaternary ammonium salt [compound (I-4)] represented by formula (I). The product was identified by NMR (400 MHz, 1H) and fat-and-oil analysis (acid value (JIS K 0070), saponification value (JIS K 0070), hydroxy value (JIS K 0070), amine value (ASTM D 2074), chloride ion concentration (silver nitrate titration), measurement of loss on drying (drying method)). A structure of the compound (I-4) is shown in Table 1.

Preparation Example 5

A quaternary ammonium salt [compound (II-1)] represented by formula (I) was prepared by the same method as in Preparation Example 1, except that 2-(2-(2-(2-(2-chloroethoxy)ethoxy)ethoxy)ethoxy)ethoxyethanol was used instead of 2-chloroethoxyethanol. The compound (II-1) was identified by the same method as in Preparation Example 1. A structure of the compound (II-1) is shown in Table 1.

Examples 1 to 9 and Comparative Examples 1 to 5

Compounds (I-1) to (I-4) and (II-1) prepared in Preparation Examples 1 to 5 and calcium chloride were used in proportions shown in Table 2 and dispersed in ion-exchanged water to obtain respective liquid softener compositions. These compositions were evaluated for (1) dispersibility and ease in handling, and (2) effects of softening and imparting water-absorbability, according to the following methods of evaluation.

(Evaluation)

(1) Dispersibility and Ease in Handling

Dispersibility was evaluated, based on ease in preparing a dispersion. More specifically, a quaternary ammonium salt (I) or mixture of quaternary ammonium salts (I) and (II) in a predetermined amount was added to hot water at about 70° C. containing a predetermined amount of calcium chloride, and vigorously stirred. From the start of stirring, a mixture that became homogeneous within 3 minutes was judged as easy-to-disperse, and a mixture that took over 3 minutes to become homogeneous was judged as hard-to-disperse. Dispersions were then observed for thickening after preparation. When cooled to a room temperature after preparation, a dispersion having fluidity was judged as easy-to-handle, a dispersion in the liquid state was judged as very easy-to-handle. Results are collectively shown in Table 2. In the evaluation, a dispersion "having fluidity" refers to that when a cylindrical glass bottle having a diameter of 25 mm and a height of 55 mm and containing 15 ml of the dispersion was quickly laid horizontally at 25° C., the dispersion moved its liquid level within 30 seconds, and a dispersion "in the liquid state" refers that the dispersion had a horizontal liquid level within 30 seconds.

(2) Effects of Softening and Imparting Water-Absorbability 24 cotton towels (marketed product, Takei Towel K.K., #3700, white) were stirred for 10 minutes in 45 L of tap water dissolving 4.5 g of Emulgen 108 (Kao Corporation, nonionic surfactant) at 20° C., rinsed twice, and dehydrated for 6 minutes. A process from stirring in the surfactant solution to dehydration was repeated twice. Then, these towels were stirred for 10 minutes in 45 L of tap water at 20° C., rinsed twice, and dehydrated for 6 minutes. A process from stirring in tap water to dehydration was repeated three times. Starches on towels were thus removed. Towels were dried, and treated for minutes with each liquid softener composition in Table 2 in such amount as that the total amount of quaternary ammonium salts in the composition was 0.1% by weight to the towels in tap water with stirring at 20° C. at a bath ratio of 30 L/kg (weight of towels). These towels were dried for 24 hours at 25° C. and 40% RH in a thermo-hygrostat. These towels were separately evaluated for softness and water-absorbability according to the following ratings. Results are also collectively shown in Table 2.

(Softness)

Treated towels were sensory evaluated by 5 special panelists. A towel treated with the liquid softener composition of Comparative Example 1 were used as a control (standard). Towels were ranked for softness according to the following scale.

+2: much softer than the control
+1: softer than the control
0: as soft as the control
−1: the control is softer
−2: the control is much softer Averages of rates ranked by 5 panelists are shown in Table 2.

(Water-Absorbability)

A towel (Takei Towel K.K., #3700, white) was treated according to the above process and conditioned at 25° C. and 40% RH in a thermo-hygrostat. From a plain-woven part of the towel, a test piece having dimensions of 2.5 cm by 25 cm was cut out. The test piece was soaked at the bottom thereof in water at 25° C. After 30 seconds from soaking, a height of water rising was measured. For towels treated with Examples 1 to 9 and Comparative Example 2, a height was again measured after 15 minutes. The experiment was repeated three times, and an average of measured heights was considered as a height of water absorption (cm). The higher height of water absorption means that a treated fabric has the higher water-absorbability.

TABLE 1

| | | Quaternary ammonium salt | | |
|---|---|---|---|---|
| | | Code | Formula | Structure |
| Preparation example | 1 | Compound(I-1) | (I) | $R^1CO$, $R^2CO$: stearate group, $R^3$, $R^4$: methyl group, k, l: 2, $X^-$: $Cl^-$ |
| | 2 | Compound(I-2) | (I) | $R^1CO$, $R^2CO$: stearate group, $R^3$, $R^4$: methyl group, k, l: 3, $X^-$: $Cl^-$ |
| | 3 | Compound(I-3) | (I) | $R^1CO$, $R^2CO$: stearate group, $R^3$, $R^4$: methyl group, k, l: 4, $X^-$: $Cl^-$ |
| | 4 | Compound(I-4) | (I) | $R^1CO$, $R^2CO$: stearate group, $R^3$, $R^4$: methyl group, k, l: 1, $X^-$: $Cl^-$ |
| | 5 | Compound(II-1) | (II) | $R^5CO$, $R^6CO$: stearate group, $R^7$, $R^8$: methyl group, m, n: 6, $X'^-$: $Cl^-$ |

TABLE 2

| | | Liquid softener composition | | | | | | | |
|---|---|---|---|---|---|---|---|---|---|
| | | Quaternary ammonium salt | | | | | | | |
| | | (I) | | | (II) | (I):(II) | Average addition mole number of oxyethylene groups per | | Calcium chloride |
| | | Code[(Ia)] | Code[(Ib)] | Code[(Ic)] | Code | (weight ratio) | Polyoxyethylene chain | weight-% | weight-% |
| Example | 1 | Compound (I-1) | — | — | Compound (II-1) | 99.9:0.1 | 2.0 | 5.0 | 0.01 |
| | 2 | Compound (I-1) | — | — | Compound (II-1) | 99.5:0.5 | 2.0 | 5.0 | 0.01 |
| | 3 | Compound (I-1) | — | — | Compound (II-1) | 99:1 | 2.0 | 5.0 | 0.01 |
| | 4 | Compound (I-1) | — | — | Compound (II-1) | 95:5 | 2.1 | 5.0 | 0.01 |
| | 5 | Compound (I-1) | — | — | Compound (II-1) | 90:10 | 2.3 | 5.0 | 0.01 |
| | 6 | Compound (I-1) | — | — | Compound (II-1) | 80:20 | 2.6 | 5.0 | 0.01 |
| | 7 | Compound (I-1) | Compound (I-2) | — | Compound (II-1) | [20:50]:30 | 3.5 | 2.5 | 0.01 |
| | 8 | Compound (I-l) | Compound (I-3) | — | Compound (II-1) | [70:10]:20 | 3.6 | 2.5 | 0.01 |
| | 9 | Compound (I-1) | Compound (I-2) | Compound (I-3) | Compound (II-1) | [30:50:10]:10 | 3.0 | 2.5 | 0.01 |
| Comparative example | 1 | Compound (I-4) | — | — | — | 100:0 | 1.0 | 2.5 | 0.01 |
| | 2 | Compound (I-1) | — | — | — | 100:0 | 2.0 | 5.0 | 0.01 |
| | 3 | Compound (I-1) | — | — | Compound (II-1) | 40:60 | 4.0 | 2.5 | 0.01 |
| | 4 | — | — | — | Compound (II-1) | 0:100 | 6.0 | 2.5 | 0.01 |
| | 5 | Compound (I-4) | — | — | Compound (II-1) | 38:62 | 3.5 | 2.5 | 0.01 |

| | | | Result of evaluation | | | |
|---|---|---|---|---|---|---|
| | | Quaternary ammonium salt/towel, | | Height of water absorption (cm) | | |
| | | in treatment weight-% | Softness* | after 30 minutes | after 15 minutes | Dispersibility handling |
| Example | 1 | 0.1 | 2 | 2.3 | 6.2 | Easy-to-disperse Easy-to-handle |
| | 2 | 0.1 | 2 | 2.1 | 5.5 | Easy-to-disperse Easy-to-handle |
| | 3 | 0.1 | 2 | 1.7 | 6.2 | Easy-to-disperse Very easy-to-handle |
| | 4 | 0.1 | 2 | 2.0 | 5.3 | Easy-to-disperse Very easy-to-handle |
| | 5 | 0.1 | 2 | 2.2 | 6.2 | Easy-to-disperse Very easy-to-handle |
| | 6 | 0.1 | 2 | 2.0 | 6.2 | Easy-to-disperse Very easy-to-handle |
| | 7 | 0.1 | 2 | 2.3 | 7.3 | Easy-to-disperse Very easy-to-handle |
| | 8 | 0.1 | 1 | 2.9 | 9.6 | Easy-to-disperse Very easy-to-handle |
| | 9 | 0.1 | 2 | 2.2 | 7.8 | Easy-to-disperse Very easy-to-handle |
| Comparative example | 1 | 0.1 | Standard | 1.0 | — | Hard-to-disperse |
| | 2 | 0.1 | 2 | 1.6 | 4.5 | Ease-to-disperse Hard-to-handle |
| | 3 | 0.1 | 0 | 2.0 | — | Ease-to-disperse Very easy-to-handle |
| | 4 | 0.1 | −1 | 3.6 | — | Ease-to-disperse Very easy-to-handle |
| | 5 | 0.1 | −1 | 2.8 | — | Ease-to-disperse Very easy-to-handle |

*A value was obtained by counting fractions of .5 and over as a whole a number and disregarding the rest..

In Table 2, in the column of (I):(II) (weight ratio), numbers in parenthesis [ ] represent proportions of (Ia) and (Ib) or (Ia), (Ib), and (IC), in this order. The amount % by weight of the quaternary ammonium salt is the total of (I) and (II). The rest part of a liquid softener is water.

The invention claimed is:

1. A method for softening a fiber product, said fiber product being selected from the group consisting of clothes and bedclothes, comprising treating the fiber product with a composition comprising a quaternary ammonium salt (I) represented by formula (I) and a quaternary ammonium salt (II) represented by formula (II) at a weight ratio of the quaternary ammonium salts (I) to (II), (I):(II), of 50.1:49.9 to 99.99:0.01:

(I)

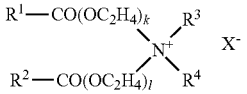

wherein, $R^1$ and $R^2$, which may be the same as or different from each other, represent a hydrocarbon group having 11 to 23 carbon atoms; $R^3$ and $R^4$, which may be the same as or different from each other, represent a hydrocarbon group having 1 to 4 carbon atoms that may have a hydroxy group; k and 1, which may be the same as or different from each other, represent an integer showing the mole number of added oxyethylene group ranging from 1 to 4; and $X^-$ represents an anion;

(II)

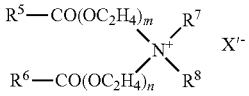

wherein, $R^5$ and $R^6$, which may be the same as or different from each other, represent a hydrocarbon group having 11 to 23 carbon atoms; $R^7$ and $R^8$, which may be the same as or different from each other, represent a hydrocarbon group having 1 to 4 carbon atoms that may have a hydroxy group; m and n, which may be the same as or different from each other, represent an integer showing the mole number of added oxyethylene group ranging from 5 to 10; and $X'^-$ represents an anion, wherein the composition further comprises an inorganic or organic salt other than the quaternary ammonium salt (I) or (II).

2. The method according to claim 1, wherein $R^1$ and $R^2$ of formula (I) represent a hydrocarbon group having 15 to 17 carbon atoms.

3. The method according to claim 1, wherein $R^5$ and $R^6$ of formula (II) represent a hydrocarbon group have 15 to 17 carbon atoms.

4. The method according to claim 1, wherein a weight ratio of quaternary ammonium salts (I) to (II), (I):(II), is 70:30 to 99:1.

5. The method according to claim 1, wherein the quaternary ammonium salts (I) and (II) are contained in the total amount of 2 to 30% by weight.

6. The method according to claim 1, wherein the fiber product is a fiber product or fabric and the fiber product or fabric is immersed in an aqueous dispersion containing the composition diluted such that the total concentration of the quaternary ammonium salts (I) and (II) is 0.001 to 3% by weight.

* * * * *